US006491499B1

(12) United States Patent
Marvin et al.

(10) Patent No.: US 6,491,499 B1
(45) Date of Patent: Dec. 10, 2002

(54) AXIAL FLOW FAN

(75) Inventors: Russel H. Marvin, Goshen, CT (US); David A. Curtis, Torrington, CT (US)

(73) Assignee: Torrington Research Company, Torrington, CT (US)

( * ) Notice: Subject to any disclaimer, the term of this patent is extended or adjusted under 35 U.S.C. 154(b) by 0 days.

(21) Appl. No.: 09/670,777

(22) Filed: Sep. 27, 2000

(51) Int. Cl.[7] ..... F04D 29/66
(52) U.S. Cl. ..... 416/203; 415/119; 416/175
(58) Field of Search ..... 416/203, 188, 416/189, 172, 175, 169 A, 228; 415/119

(56) References Cited

U.S. PATENT DOCUMENTS 1,893,184 A * 1/1933 Smellie ..... 416/203
2,639,886 A * 5/1953 Townhill et al. ..... 416/189
3,842,902 A * 10/1974 Poslusny ..... 416/192
4,253,800 A * 3/1981 Swgawa et al. ..... 416/203
4,863,351 A * 9/1989 Fischer et al. ..... 416/203
5,000,660 A * 3/1991 Van Houten et al. ..... 416/203
5,740,766 A * 4/1998 Moser ..... 416/215

* cited by examiner

*Primary Examiner*—Edward K. Look
*Assistant Examiner*—Thomas E. Lazo
(74) *Attorney, Agent, or Firm*—Theodore R. Paulding

(57) ABSTRACT

An axial flow fan comprises a hub rotatable on a central axis and a plurality of radial blades extending from the hub, each having a root portion adjacent the hub and each having tip portion space radially from the hub and surrounded by an annular band. The root portions are substantially equally spaced circumferentially at their junctions with the hub and at least some of the tip potions are substantially unevenly space circumferentially. The latter is due to the condition that blade centerlines are pivoted through unequal angles about points along the junctions between the hub and the blade root portions.

6 Claims, 2 Drawing Sheets

AXIAL FLOW FAN

BACKGROUND OF THE INVENTION

It is known that a significant reduction in noise generation by axial flow fans can be achieved by providing uneven or unequal spacing between the fan blades particularly at their tip portions.

An example of such a fan design in the prior art is illustrated and described in U.S. Pat. No. 5,000,660 to Houten et al. In the Houten patent, the fan blades are skewed to provide for uniform spacing of the blades at the root portion and unequal spacing at tip potions. Skewing of the blades is accomplished by altering the curvature of the blades between root and tip portions in a plane perpendicular to the fan axis. Thus, a gradual curvature of a blade center line from root to tip has a significantly different skew than a relatively sharp curvature of a blade center line running from the mid point of the blade at its root to its tip mid point.

While the foregoing blade design is generally satisfactory, it nevertheless has disadvantages particularly in difficulty encountered in plastic molding processes associated with the production of the blades. Blades with a relatively sharp curvature of their center lines are obviously more difficult and, or expensive to mold than blades having gradually curved center lines. Further, a number of blade configurations each with different curvatures of their center lines also adds to cost of production.

It is the general object of the present invention to provide an improved axial flow impeller which exhibits equal spacing between blades at their root portions and unequal spacing between the blades at their tip portions, and which may be manufactured at economic advantage while retaining and even improving noise reduction characteristics.

SUMMARY OF THE INVENTION

In accordance with the present invention and in fulfillment of the foregoing object, an axial flow fan is provided with a hub and a plurality of generally radial blades extending from the hub periphery. Each blade comprises a root portion adjacent the hub and terminates in a tip portion spaced radially from the hub. The root portions of the blades are spaced evenly at their junctions with the hub while the tip portions thereof are substantially unevenly spaced circumaxially due to the blades being pivoted about their center lines through unequal arcs about points along the junctions between the hub and the blade root portions. Preferably, the mid points of the junctions between the hub and the root portion are used as pivot points for the arcuate placement of the blades. Any desired pattern of unequal blade tip spacing can thus be achieved without resort to unequal curvature of the blades and, in fact, without resort to any substantial change in the configuration of the blades. Only the slightest modification in blade shape at root and tip portions is necessary from blade to blade.

DRAWINGS

Figure 1:
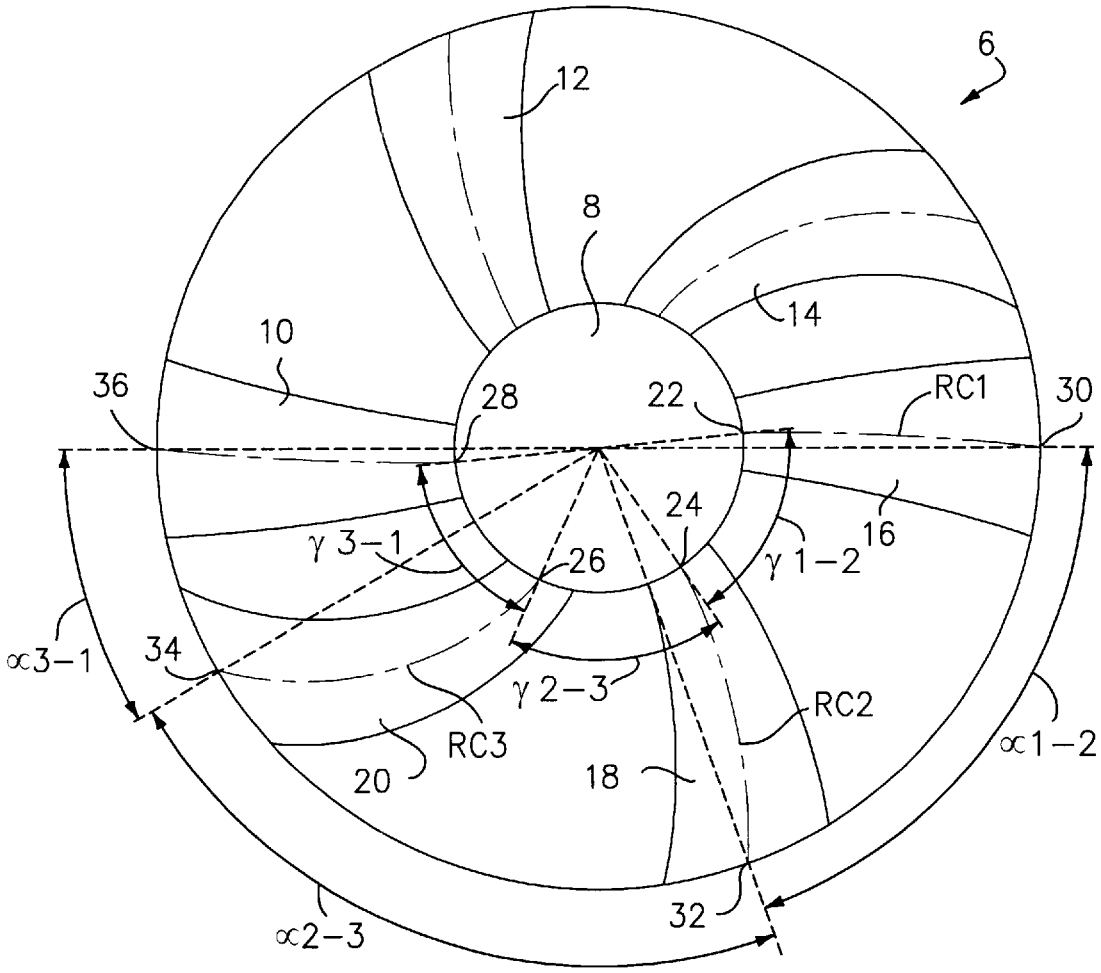
FIG. 1 PRIOR ART

FIG. 1 is a schematic view of a Prior Art fan of U.S. Pat. No. 5,000,660.

Figure 2:
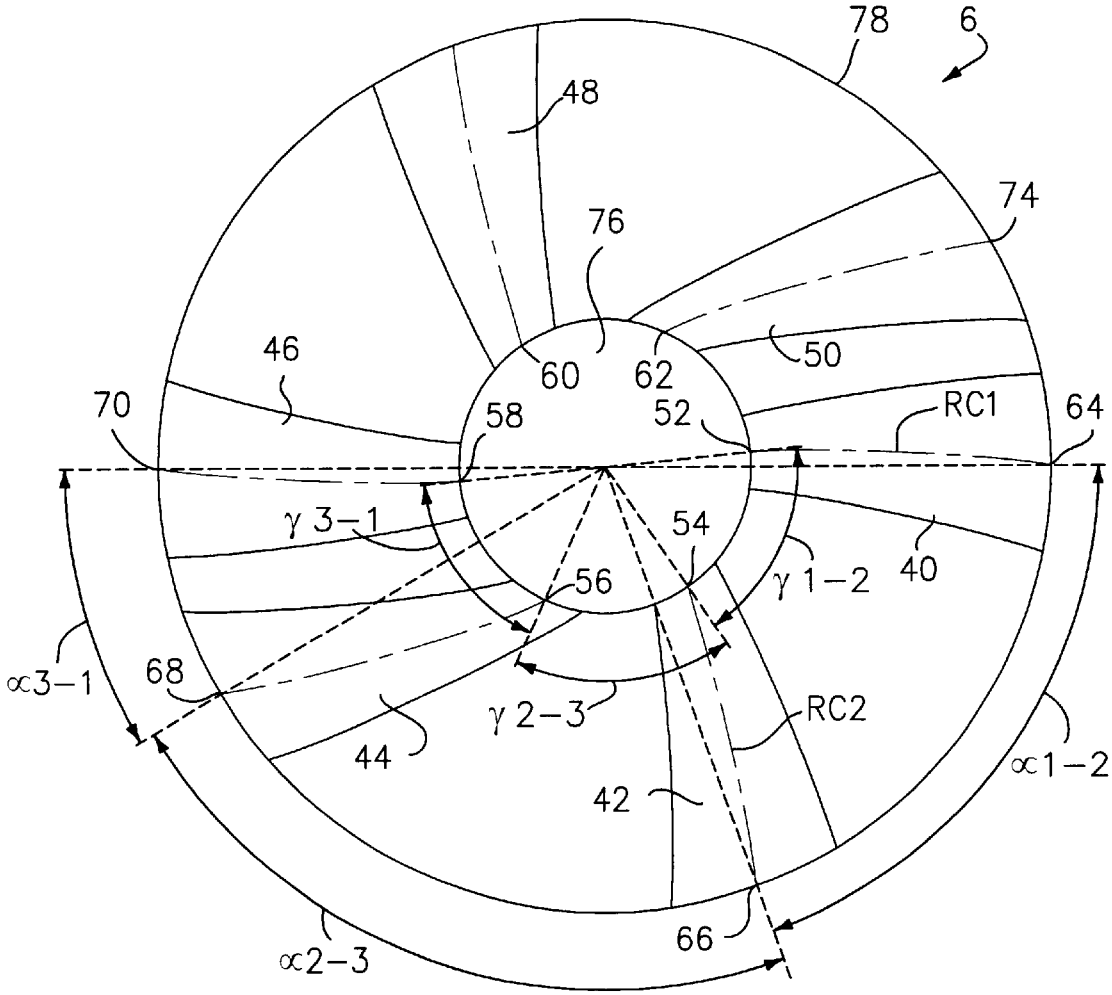

FIG. 2 is a schematic view of the improved fan of the present invention.

DETAILED DESCRIPTION OF THE PREFERRED EMBODIMENT

Referring initially to the Prior Art schematic of FIG. 1 an axial fan is indicated generally at FIG. 10 and has a hub 8 and six blades 10, 12, 14, 16, 18 and 20 in first and second groups. That is, the blades 10, 12, 14 form a first group and blades 16, 18, 20 form a similar second group. The blades 16, 18, 20 will now be described as representative also of blades 10, 12, 14. The angles $\partial_{1-2}$, $\partial_{2-3}$, $\partial_{3-1}$, are equal indicating that the blades 16, 18, 20 as well as the blades 10, 12, 14 are equally spaced measured from their root mid points 22, 24, 26 and 28.

Measuring to tip mid points 30, 32, 34, and 36, the $\propto_{1-2}$, $\propto_{2-3}$, and $\propto_{3-1}$, illustrate unequal spacing of the blades 16, 18, 20 and 10 at their tip portions. Annular band 30 surrounds the blades.

Arcuate center lines of the blades are indicated at RC1, RC2, RC3 and it will be noted that the curvature of center line RC1 is quite shallow, the curvature of the center line of RC2 is somewhat sharper and the curvature of the center line of RC3 is substantially sharper. The respective curvatures of the blade center lines account for the unequal spacing at tip portions of the blades as represented by $\propto_{1-2}$, $\propto_{2-3}$, $\propto_{3-1}$. Further, it will be noted that the configuration of the blades varies substantially from blade to blade. In other words, the blade configurations must be altogether different in order to provide the desired unequal spacing at the blade tip portions.

Referring now to FIG. 2 it will be observed that a fan illustrated at 10*a* includes a hub 76 annular band 78, and 6 blades 40, 42, 44, 46, 48, 50. The blades comprise two groups blades 40, 42, 44 group one corresponding to blades 46, 48, 50 of group two. The blades 40–42 will now be described and are to be taken as representative also of blades 46–50.

Blade 40 is similar to blade 16 of the prior art fan 10 and has a root mid point 52 and a tip mid point 64 as well as an arcuate center line RC1. Root portion spacing of the blade 40 from the blade 42 is illustrated by the angle $\partial_{1-2}$ between root mid points 52 and 54. The $\partial_{2-3}$ between root mid points 54–56 of blades of 42 and 44 is equal to the angle $\partial_{1-2}$, as is the angle $\partial_{3-1}$ between root mid points 56 and 58 respectively of blades 44 and 46. Thus, spacing between all of the blades 40, 42, 46 is substantially equal at root portions thereof.

The angle $\propto_{1-2}$ between mid points 64 and 66 of blades 40 and 42 at their tips is of course substantially larger than the angle $\partial_{1-2}$ and also differs substantially from the angle $\propto_{2-3}$ between the tip mid points 66 and 68 of the blades 42 and 44. The angle $\propto_{3-1}$ between tip mid points 68 and 70 of blades 44 and 46 is substantially less than either of the angles $\propto_{1-2}$ and $\propto_{2-3}$. Thus, each of the blades 40, 42, 44 and 46 is unequally spaced at tip portions as are the blades 70, 72, and 74 of group 2.

In the design of axial fan 10*a*, the blades 40–74 are substantially identical with angles of curvature of their center lines RC1, RC2, et sequa also being identical. As mentioned, only the slightest of modifications in blade design is necessary at root and tip portions of the blades. This is due to the fact that the blade center lines are pivoted about points along the junctions between their root portions and the supporting hub 76. Preferably and as shown, the blades are pivoted about the mid point 52–60 of the junction lines between the blades and the hub.

With the foregoing arrangement, the performance of a fan such as 10*a* is found to exhibit noise reduction characteristics at least equal to the prior art fan mentioned and, is in fact, superior in the generation of sound which is more pleasing to the ear. Moreover, the fan may be manufactured at substantial economic advantage as indicated above with substantially identical blade design and the absence of sharply curved blades.

What is claimed is:

1. An axial flow fan of unitary molded plastic construction comprising: a cent hub rotatable on an axis; and a plurality of radial blades extending from the hub periphery, each of the blades comprising a root portion adjacent the hub and a curving mid portion terminating in a tip portion remote from the hub, and each of the blades having a substantially identical curved longitudinal centerline and being configured to perform a major part of its air moving function at its tip portion but with a substantial part of its air moving function at its mid piont portion, the root potions of the blades being substantially evenly spaced from each other circumferentially at their junctions with the hub, and at least some of the blades being substantially unevenly spaced circumferentially from each at both their mid portions and tip portions due to the blades being skewed with their center lines pivoted through unequal angles about selected points along the junction lines between the hub and the blade root portions, major sound attenuation improvement and lesser but nevertheless substantial sound attenuation improvement thus being achieved respectively at tip and mid portions of the blades.

2. The axial flow fan of claim 1 wherein the blade tips are interconnected by an annular band.

3. The axial flow fan of claim 1 comprising at least two substantially identical groups of blades.

4. The axial flow fan of claim 1 wherein the blade center lines are each pivoted bout their root mid point.

5. The axial flow fan of claim 4 wherein the blade center lines are all pivoted in the same arcuate direction.

6. The axial flow fan of claim 4 wherein the blades are forwardly curved.

* * * * *